US006779463B2

(12) United States Patent
Mutascio et al.

(10) Patent No.: US 6,779,463 B2
(45) Date of Patent: Aug. 24, 2004

(54) SABOT-LAUNCHED DELIVERY APPARATUS FOR NON-LETHAL PAYLOAD

(75) Inventors: Enrico R. Mutascio, Coachella, CA (US); Paul D. Heidenreich, Coachella, CA (US); James M. Krushat, Coachella, CA (US); Bogdan I. Vladescu, Coachella, CA (US)

(73) Assignee: Armtec Defense Products Company, Coachella, CA (US)

( * ) Notice: Subject to any disclaimer, the term of this patent is extended or adjusted under 35 U.S.C. 154(b) by 0 days.

(21) Appl. No.: 10/305,931

(22) Filed: Nov. 27, 2002

(65) Prior Publication Data

US 2003/0110973 A1 Jun. 19, 2003

Related U.S. Application Data

(60) Provisional application No. 60/333,578, filed on Nov. 27, 2001.

(51) Int. Cl.[7] ..... F42B 8/14; F42B 12/36; F42B 14/00; F42B 30/10

(52) U.S. Cl. ..... 102/502; 102/373; 102/393; 102/445; 102/520

(58) Field of Search ..... 102/357, 363, 102/367–370, 372, 373, 393, 395, 444, 445, 489, 498, 502, 503, 520–523

(56) References Cited

U.S. PATENT DOCUMENTS

| | | | | | |
|---|---|---|---|---|---|
| 2,383,053 | A | * | 8/1945 | Fanger et al. | 102/372 |
| 2,775,943 | A | * | 1/1957 | Ekserzian | 102/523 |
| 3,194,161 | A | * | 7/1965 | Becker et al. | 102/498 |
| 3,791,303 | A | * | 2/1974 | Sweeney et al. | 102/502 |
| 3,911,824 | A | * | 10/1975 | Barr et al. | 102/502 |
| 4,392,432 | A | * | 7/1983 | Fenrick et al. | 102/367 |
| 4,434,718 | A | | 3/1984 | Kopsch et al. | 102/522 |
| 4,505,203 | A | * | 3/1985 | Brady et al. | 102/393 |
| 5,121,692 | A | * | 6/1992 | DiCarlo | 102/439 |
| 5,361,700 | A | * | 11/1994 | Carbone | 102/502 |
| 5,423,262 | A | * | 6/1995 | Pettersson et al. | 102/212 |
| 6,460,460 | B1 | * | 10/2002 | Jasper, Jr. et al. | 102/201 |
| 2002/0088361 | A1 | * | 7/2002 | Mac Aleese et al. | 102/502 |

FOREIGN PATENT DOCUMENTS

| | | |
|---|---|---|
| FR | 2385075 | 10/1978 |

OTHER PUBLICATIONS

International Search Report for International Application No. PCT/US02/38033, Armtec Defense Products Co., Dec. 4, 2003 (2 pages).

* cited by examiner

*Primary Examiner*—Michael J. Carone
*Assistant Examiner*—James S. Bergin
(74) *Attorney, Agent, or Firm*—Perkins Coie LLP

(57) ABSTRACT

A non-lethal payload delivery assembly for use with a launching device having a non-lethal payload releasably contained in a carrier assembly. The carrier assembly being openable upon application of a deploying force to deploy the non-lethal payload after the carrier assembly and the non-lethal payload are launched as a unit from the launching device. An openable sabot assembly releasably contains the carrier assembly during before and during launch. The sabot assembly configured to absorb launch forces that exceed the strength of the carrier assembly alone independent of the sabot assembly. A payload deployment system connected to the carrier assembly is activatable after separation of the carrier unit from the sabot assembly following launch. The payload deployment system opens the carrier assembly for deployment of the non-lethal payload away from the carrier assembly and before reaching the target.

21 Claims, 6 Drawing Sheets

SABOT-LAUNCHED DELIVERY APPARATUS FOR NON-LETHAL PAYLOAD

CROSS-REFERENCE TO RELATED APPLICATIONS

This non-provisional application claims priority to Provisional U.S. Patent Application No. 60/333,578, entitled SABOT-LAUNCHED DELIVERY APPARATUS FOR NON-LETHAL PAYLOAD, filed Nov. 27, 2001, hereby incorporated in its entirety by reference thereto.

BACKGROUND

Law enforcement and military personnel often use non-lethal weapons to help dissuade persons from engaging in unlawful or undesirable behavior. The non-lethal weapons used for this application, such as airborne irritant agents and shot-filled bags, typically deliver induced or inflicted discomfort. The non-lethal payload is contained in a carrier projectile, given flight impetus by some source of stored energy, accelerated in the barrel of the launching device, and then sent on an aerodynamic trajectory to the target.

While the actual non-lethal payload depends on its carrier projectile's kinetic energy to perform its mission, the projectile itself is not configured or intended to deliver blunt trauma. It is desirable for the carrier projectile to rapidly shed its kinetic energy upon release of the non-lethal payload. A projectile constructed from lightweight material will quickly shed kinetic energy, but it will not be able to withstand the forces of launch while in the barrel of the launching device.

SUMMARY OF THE INVENTION

Under one aspect of the present invention, a non-lethal payload delivery assembly is provided having a carrier assembly releasably contained in a sabot assembly. Under another aspect, a method for launching the non-lethal payload delivery assembly from the launching device while protecting the carrier assembly from the forces of launch is provided. In one embodiment, the non-lethal payload delivery assembly includes a carrier assembly that releasably contains a non-lethal payload. The carrier assembly is openable upon application of a deploying force to deploy the non-lethal payload after the carrier assembly and the non-lethal payload are launched as a unit.

The carrier assembly is releasably contained in a sabot assembly having a plurality of sections movable from a closed position substantially surrounding the carrier assembly to an open position exposing the carrier assembly upon launch from the launching device. The sabot assembly is configured to absorb launch forces that exceed the deploying force during launch and allowing the carrier assembly and the non-lethal payload to survive the launch as a unit. A payload deployment system is connected to the carrier assembly and is activatable after launch for delivery of the deploying force that opens the carrier assembly for deployment of the non-lethal payload away from the carrier assembly.

DETAILED DESCRIPTION

The present disclosure describes apparatus and methods for launching a non-lethal payload and delivering the payload to a target area. In the following description, many specific details are set forth in order to provide a thorough understanding of various embodiments of the invention. One skilled in the art, however, will understand that the invention may be practiced without these details. In other instances, well-known structures associated with sabot-delivery systems have not been shown or described in detail to avoid unnecessarily obscuring the description of the embodiments of the invention. FIGS. 1–6 illustrate a system and components of the non-lethal payload delivery system in accordance with the embodiments of the present invention. Several of the components described below with reference to FIGS. 1–6 can also be used for performing methods in accordance with aspects of the present invention. Therefore, like references refer to like components and features throughout the various figures.

Figure 1:
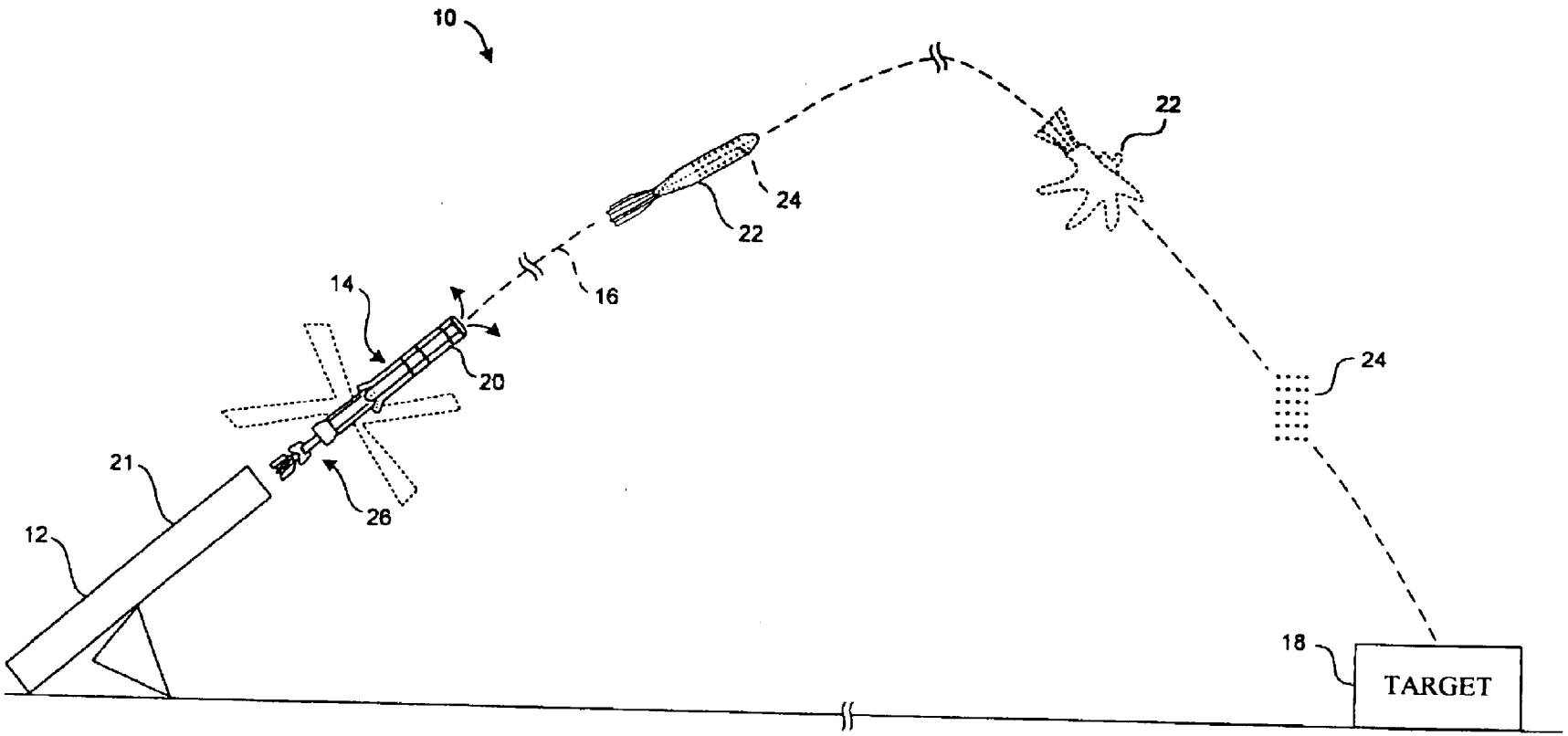
FIG. 1 is a schematic view of a non-lethal payload delivery system in accordance with one embodiment of the invention.

FIG. 1 is a schematic view of a non-lethal payload delivery system 10, illustrating the various components of the system. The delivery system 10 includes a launching device 12 that launches a non-lethal payload delivery assembly 14 along a selected trajectory 16 toward a designated target 18. The delivery assembly 14 includes a sabot assembly 20 adapted to be loaded into and launched from a barrel 21 of the launching device 12. The sabot assembly 20 releasably contains and protects a carrier assembly 22 during the launch process.

The carrier assembly 22 carries a non-lethal payload 24 from the launching device 12 along the trajectory 16 to a selected location away from the target 18. The carrier assembly 22 then ejects the non-lethal payload 24 for delivery to the target. The non-lethal payload 24 can be any one of several non-lethal devices, such as airborne irritant agents, shot-filled bags, foams, flash/bang grenades, rubber pellets, anti-traction agents, or the like.

Figure 2:
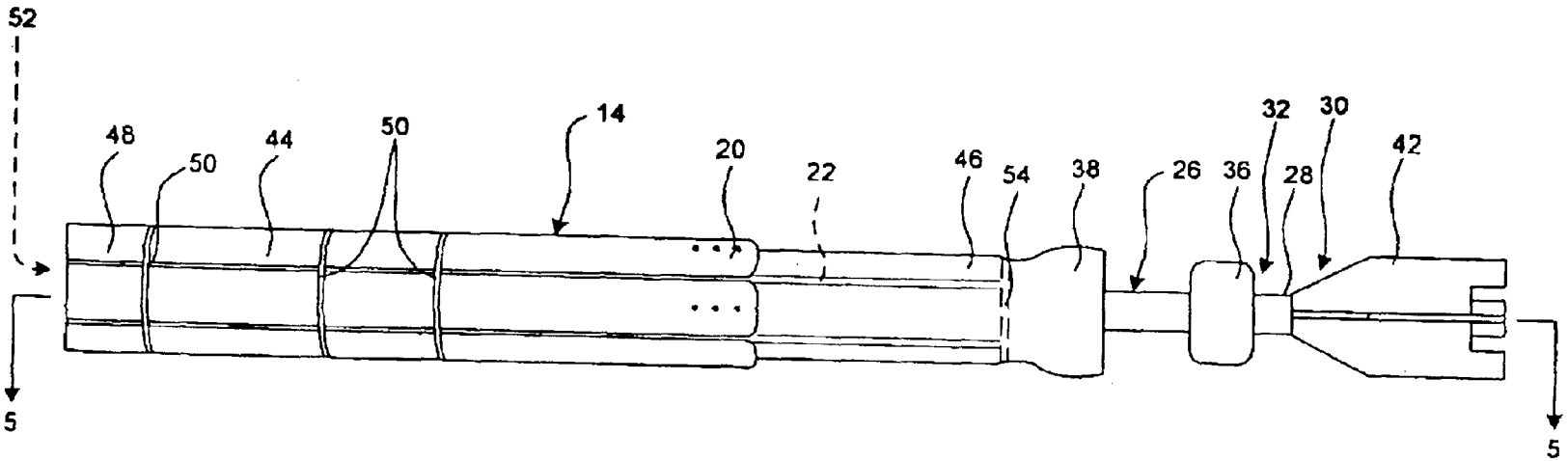
FIG. 2 is a side elevation of a non-lethal payload delivery assembly used with the system of FIG. 1.

FIG. 2 is an enlarged elevation view of the non-lethal payload delivery assembly 14 with the carrier assembly 22 shown in a nested position in the sabot assembly 20 and in a pre-firing configuration. In this pre-firing configuration, the sabot assembly 20 is adapted to protect the carrier assembly 22 and the non-lethal payload 24 (not visible), particularly during the launch. In the illustrated embodiment, the sabot assembly 20 includes an integral propulsion system 26 that drives the sabot assembly and the carrier assembly 22 out of the launching device 12 (FIG. 1) as a unit.

Figure 3:
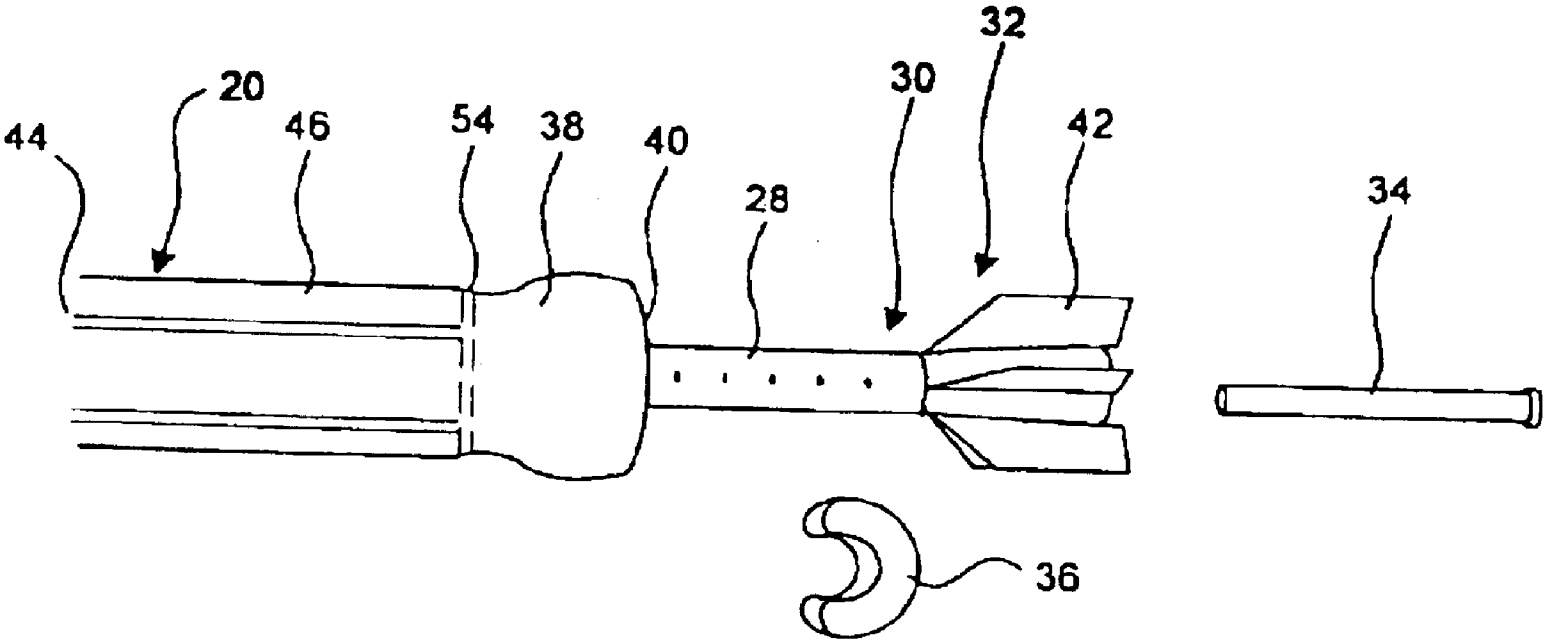
FIG. 3 is an enlarged isometric view of a partially unassembled portion of the non-lethal payload delivery assembly of FIG. 2.

As best seen in FIGS. 2 and 3, the propulsion system 26 is received in and on a hollow, perforated shaft 28 of a tail boom 30 that forms a reward end portion 32 of the sabot assembly 20. The tail boom 30 also includes a plurality of alignment fins 42 connected to the aft end of the shaft 28. The alignment fins 42 help provide alignment of the sabot assembly 20 within the barrel 21 of the launching device.

The propulsion system 26 includes a conventional ignition cartridge 34 inserted into the perforated shaft 28, and a horseshoe-shaped propellant increment 36 mounted onto a middle portion of the perforated shaft. The ignition cartridge 34 of the illustrated embodiment is similar to an M299 ignition cartridge used in various military applications. The propellant increment 36 is similar to an M205 horseshoe propellant increment, which is also used in military applications. The propulsion system 26, when activated creates high-pressure propelling gasses within the barrel 21 of the launching device 12 (FIG. 1) to fire the non-lethal payload delivery assembly 14 out of the launching device as a unit.

The shaft 28 of the tail boom 30 is connected at its forward end to a cylindrical sealing feature 38 of the sabot assembly 20. The sealing feature 38 is positioned forwardly adjacent to the propulsion system 26 and provides an aft driving surface 40 against which high-pressure propelling gasses from the propulsion system push during launch. The high-pressure propelling gases cause the sealing feature 38 to flare radially and substantially seal against the barrel 21 of the launching device 12 (FIG. 1). Accordingly, the sealing feature 38 prevents blow-by of the propelling gasses during launch from the launching device 12 (FIG. 1).

The sealing feature 38 of the sabot assembly 20 is pivotally connected to a plurality of parallel longitudinal sections, also referred to as sabot petals 44. When the sabot assembly 20 is in the pre-fired configuration, the sabot petals 44 define an elongated cylindrical area that releasably contains the carrier assembly 22. Accordingly, the sabot petals 44 surround and isolate the carrier assembly 22 from the launch environment within the barrel 21 of the launching device 12 (FIG. 1) when the propulsion system 26 is activated. The sabot petals 44 may be constructed of metal, plastic, or other material suitable to protect the carrier assembly 22 from launching forces created in the launching device 12 (FIG. 1).

Figure 5:
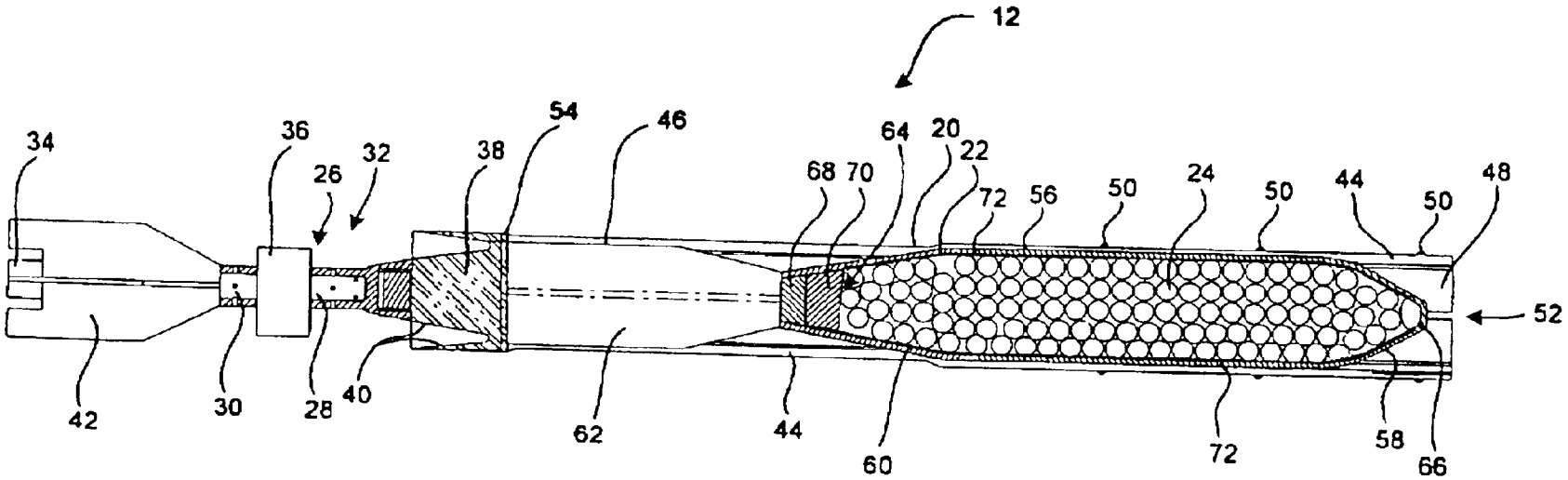
FIG. 5 is an enlarged cross-sectional view taken substantially along lines 5—5 of FIG. 2 showing the non-lethal payload delivery assembly.

As best seen in FIGS. 2 and 5, the aft ends 46 of the sabot petals 44 are pivotally connected to the sealing feature 38, but the forward ends 48 are free and not integrally connected to each other. In the illustrated embodiment, the sabot petals 44 are banded together near the forward ends by a plurality of bands 50. The bands 50 hold the sabot petals 44 in a closed, launching position, thereby enclosing the carrier assembly 22 within the sabot assembly 20 in an alternate embodiment, the sabot petals 44 can have integral breakable tabs interconnecting adjacent petals and holding the sabot petals in the closed position until the delivery assembly 14 is launched. The breakable tabs are configured to break and release the sabot petals after the delivery assembly 14 is fired from the launching device.

When the sabot petals 44 are in the closed, launching position, the forward ends 48 form an open, cup-shaped area 52 at the leading end of the sabot assembly 20. When the propulsion system 26 is activated and the sabot assembly 20 and the carrier assembly 22 are fired from the barrel 21 (FIG. 1) of the launching device 12 (FIG. 1), the cup-shaped area 52 of the sabot assembly 20 acts to catch air therein. The air becomes substantially trapped in the cup-shaped area 52, resulting in a significant pressure build up within the cup-shaped area. This pressure build up results in a radially outward force being exerted against the sabot petals 44.

While the sabot assembly 20 is still in the barrel 21 of the launching device 12 (FIG. 1), the barrel holds the sabot petals in the closed, launching position around the carrier assembly 22. Upon exit from the barrel 21 (FIG. 1), however, the sabot petals 44 are no longer confined by the barrel 21 to the closed, launching position. The bands 50 around the sabot petals 44 are elastomeric bands specifically designed to break when subjected to the radially outward forces encountered immediately after the sabot assembly 20 exits the barrel 21 (FIG. 1). The radial forces break the bands 50, and the sabot petals 44 are then free to pivot in a flowering motion from the closed, launching position to an open, deploying position. In the illustrated embodiment, the sabot petals 44 each have a thin hinge portion 54 that connects the respective sabot petal to the sealing feature 38. Accordingly, these hinge portions 54 provide the pivot points for the sabot petals 44 as they flare toward the open, deployed position, thereby facilitating the flowering action to deploy the carrier assembly 22 along its trajectory 16 (FIG. 1) toward the target 18.

When the sabot petals 44 are in the open, deploying position, the carrier assembly 22 is fully exposed. The sabot assembly 20 has a much larger cross-sectional area in a plane substantially normal to the trajectory 16 (FIG. 1), and this larger cross-sectional area greatly increases the aerodynamic drag on the sabot assembly 20, thereby rapidly decelerating the sabot assembly 20 immediately after launch. While the carrier assembly 22 exits the barrel 21 (FIG. 1) with substantially the same velocity as the sabot assembly 20, the carrier assembly is not fixed to the sabot assembly and is not subjected to the same deceleration. Accordingly, the rapid deceleration of the open sabot assembly 20 allows for clean axial separation of the carrier assembly 22 from the sabot assembly. After separation, the open sabot assembly 20 drops harmlessly to the ground a short distance in front of the launching device 12 (FIG. 1) while the carrier assembly 22 continues on its trajectory 16 toward the target 18 for delivery of the non-lethal payload 24.

Figure 4:
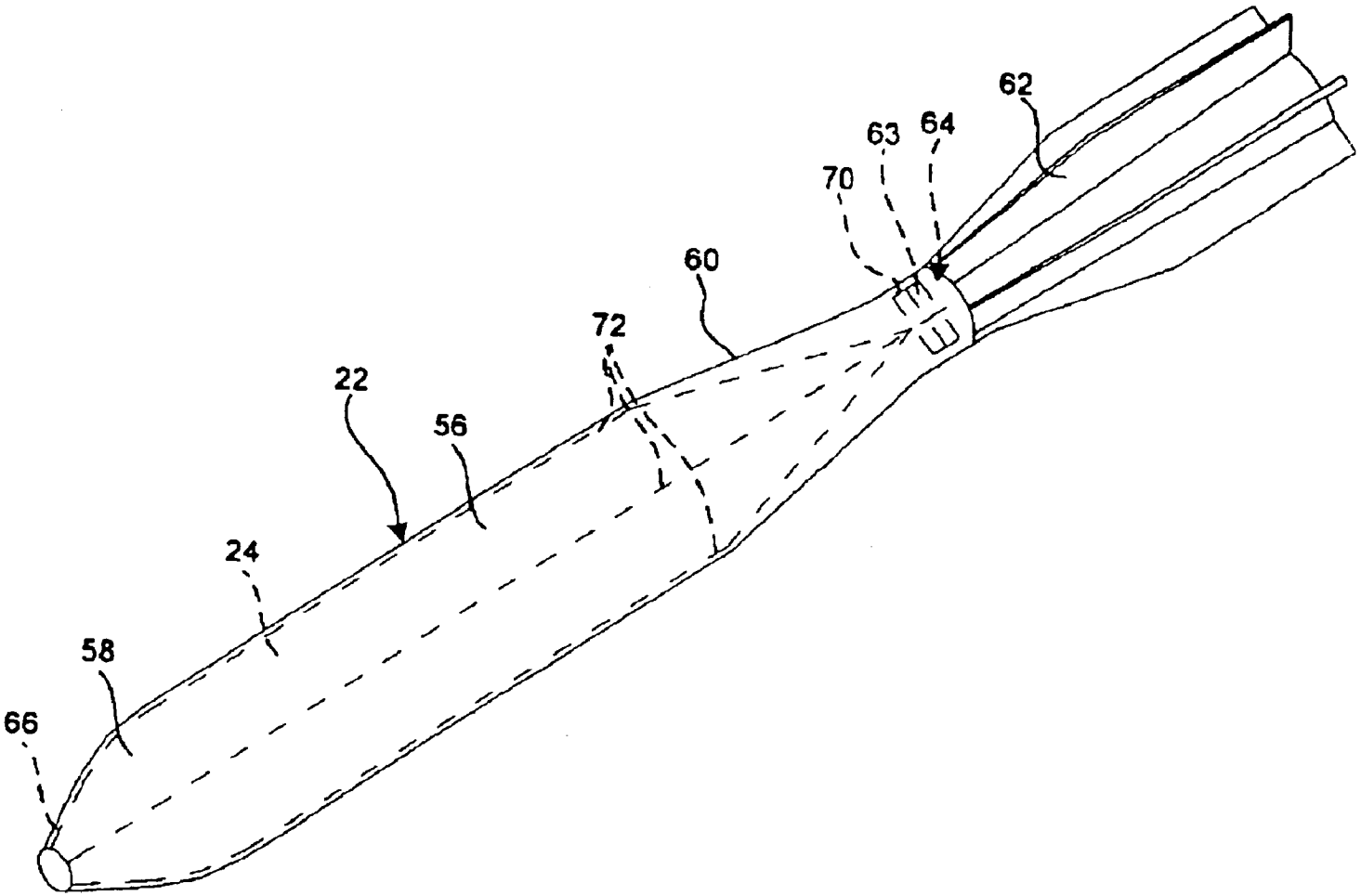
FIG. 4 is an enlarged isometric view of a carrier assembly of the non-lethal payload delivery assembly of FIG. 2.

FIG. 4 is an enlarged isometric view of the carrier assembly 22 shown separated from the sabot assembly 20 (FIG. 1). The carrier assembly 22 has a generally cylindrical body 56 that fully contains the non-lethal payload 24 in the illustrated pre-fired condition. The body 56 has a tapered nose section 58, a tapered aft section 60, and a plurality of molded aerodynamic stabilizing fins 62 integrally attached to the tapered aft section. The fins 62 provide stability to the launched carrier assembly 22 after the carrier assembly separates from the sabot assembly 20 (FIG. 1). In one embodiment, the fins 62 can have features such as a leading edge bevel that will induce slow rolling or spining of the carrier assembly 22 about its longitudinal axis during flight to increased the carrier assembly's in-flight stability.

The body 56 and stabilizing fins 62 of the carrier assembly 22 of the illustrated embodiment are fabricated of a molded fiber material configured for stable, accurate aerodynamic flight. The molded fiber material, however, is not strong enough by itself to withstand the forces of launch within the launching device 12 (FIG. 1). Accordingly, the sabot assembly 20 described above isolates the carrier assembly 22 from the launch environment. The molded fiber material used for the carrier assembly 22 for the illustrated embodiment is manufactured by Armtec Defense Products, of Coachella, Calif. In this embodiment, the body 56 and stabilizing fins 62 of the carrier assembly 22 have a one-piece molded configuration molded around the non-lethal payload 24, although alternate embodiments can have a multi-piece configuration.

The carrier assembly 22 of the illustrated embodiment is adapted to open and deploy the non-lethal payload 24 when the carrier assembly is at a selected position along the trajectory 16 (FIG. 1) so that only the non-lethal payload reaches the target 18. As best seen in FIGS. 4 and 5, the carrier assembly 22 includes a payload deployment system 64 contained within the molded body 56. The payload deployment system 64 includes a nose-section radar 66 contained in the tapered nose section 58 and coupled to a microelectronic control system 68 contained near the tapered aft section 60. The microelectronic control system 68 is also coupled to a fusing system 70 adapted to activate a plurality of linear-shaped charges 72 mounted along the inside surface of the molded body 56. The fusing system 70 of the illustrated embodiment is an airburst fusing system substantially identical to the M734 multifunction fuse used in various military applications, although other fusing devices can be used in alternate embodiments.

The fusing system 70 is a "safe and arm" fusing system that does not activate the nose-section radar 66 until certain input criteria are met. For example, the fusing system 70 can include input sensors that monitor such things as acceleration forces, sabot discard, spin of the carrier assembly 22, and/or elapsed time from launch. Once the input criteria are satisfied, the nose-section radar 66 is activated and sends selected data to the microelectronic control system 68. The microelectronic control system 68 interprets the data from the nose-section radar 66, and when predetermined conditions are satisfied, the control system activates a fuse that ignites the linear-shaped charges 72. In the illustrated embodiment, the fusing system 70 includes a proximity fuse activated when the nose-section radar 66 senses that the carrier assembly 22 is at a selected height above the ground, although other activating criteria could be used.

The linear-shaped charges 72 are a series of small explosive charges that, when ignited, perforate and open the body 56 of the carrier assembly 22 to expose and deploy the non-lethal payload 24. The air pressure and increased aerodynamic drag on the open perforated sections cause at least the body 56 of the molded fiber carrier assembly 22 to be shredded virtually instantly into a plurality of irregularly-shaped, light-weight remnant pieces. These remnant pieces will have a high aerodynamic drag, thereby resulting in very rapid deceleration and loss of kinetic energy. Accordingly, the remnant pieces will fall harmlessly to the ground away from the target 18 (FIG. 1) while the non-lethal payload 24 continues along the trajectory 16 to the target.

Figure 6:
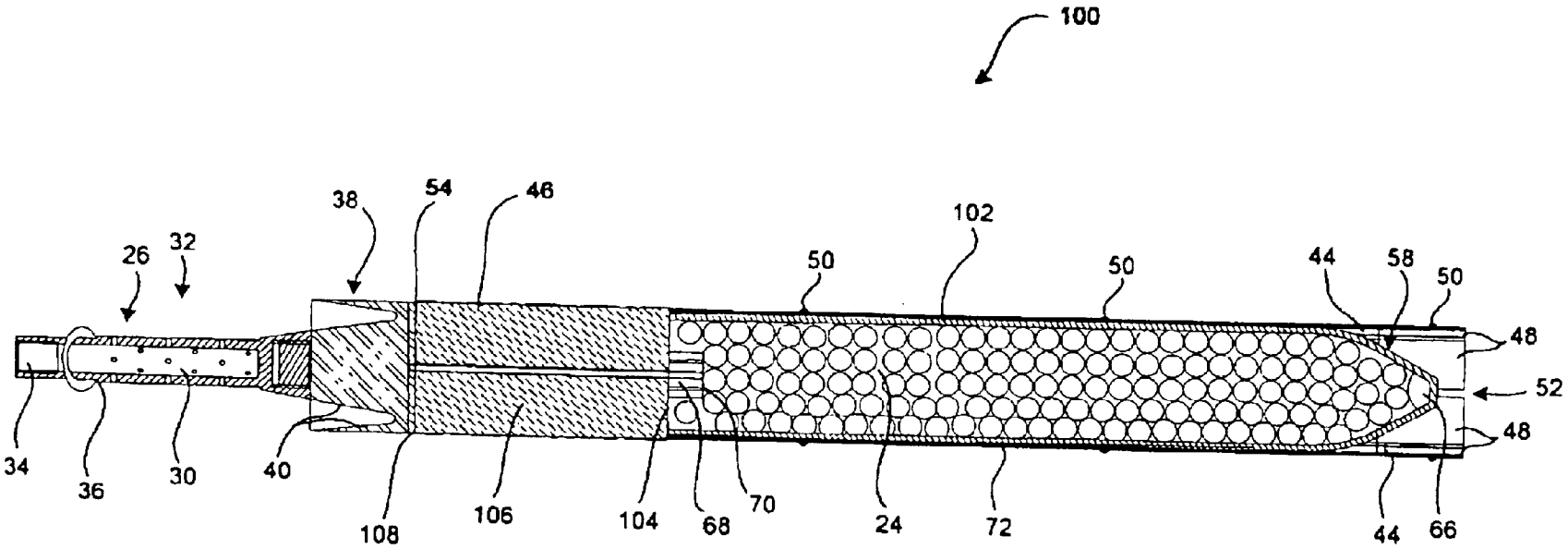
FIG. 6 is a cross-sectional view of a non-lethal payload delivery assembly in accordance with an alternate embodiment of the invention.

FIG. 6 is a cross-sectional view of the non-lethal payload delivery assembly 14 in accordance with an alternate embodiment of the invention. In this alternate embodiment, the reward end portion 32 of the sabot assembly 20 includes the tail boom 30 with the hollow shaft 28 that receives the ignition cartridge 34 and the propellant increment 36. The tail boom 30, however, does not include stabilizing fins as in the embodiment described above. The sabot assembly 20 maintains sufficient alignment within the barrel 21 of the launching device (FIG. 1) via the sealing feature 38 that flares into sealable engagement with the barrel during launch. In addition, the bands 50 around the sabot petals 44 are shaped and sized to slidably engage the inside surface of the barrel 21 when the sabot assembly 20 is inserted for launch. Accordingly, the bands 50 also help maintain axial alignment with the barrel 21 until the sabot assembly 20 exits the barrel, flowers and separates from a molded fiber carrier assembly 100 protectively contained therein.

The carrier assembly 100 in this alternate embodiment also has a slightly different configuration from the carrier assembly in the embodiment described above. The carrier assembly 100 has a generally bullet-shaped body portion 102 with a substantially flat aft end 104. A plurality of stabilizing fins 106 are connected to the body's flat aft end 104 to provide aerodynamic stability to the carrier assembly 100 in flight along the trajectory 16 (FIG. 1). A layer of energy absorbent material 108 is positioned between ends of the stabilizing fins 106 and the sealing feature 38 of the sabot assembly 20. The layer of energy absorbent material 108 helps isolate the carrier assembly 100, particularly at the stabilizing fins 106 and the body's flat aft end 104, from acceleration loads, known in the industry as "set back," upon launch from the launching device 12 (FIG. 1).

From the foregoing, it will be appreciated that specific embodiments of the invention have been described herein for purposes of illustration, but that various modifications may be made without deviating from the spirit and scope of the invention. Accordingly, the invention is not limited except as by the appended claims.

We claim:

1. A non-lethal payload delivery assembly for use with a launching device, comprising:

a non-lethal payload deliverable to a target;

a carrier assembly releasably containing the non-lethal payload, the carrier assembly being openable and separable from the non-lethal payload prior to delivery to the target upon application of a deploying force to deploy the non-lethal payload after the carrier assembly and the non-lethal payload are launched as a unit;

a sabot assembly releasably containing the carrier assembly, the sabot assembly having a plurality of sections movable from a closed position substantially surrounding the carrier assembly to an open position exposing the carrier assembly upon launch from the launching device, the sabot assembly configured to absorb launch forces that exceed the deploying force during launch and allowing the carrier assembly and the non-lethal payload to survive the launch as a unit; and a payload deployment system connected to the carrier assembly, the payload deployment system being activatable after launch and prior to delivery of the non-lethal payload to the target for delivery of the deploying force that opens the carrier assembly for deployment of the non-lethal payload away from the carrier assembly.

2. The non-lethal payload delivery assembly of claim 1 wherein the non-lethal payload is at least one of an airborne irritant agent, shot-filled bag, foam, flash/bang grenade, rubber pellet, and anti-traction agent.

3. The non-lethal payload delivery assembly of claim 1 wherein the carrier assembly is a non-metallic assembly configured to break into a plurality of non-lethal pieces upon being opened for deployment of the non-lethal payload.

4. The non-lethal payload delivery assembly of claim 3 wherein the carrier assembly is constructed from a molded fiber material.

5. The non-lethal payload delivery assembly of claim 1 wherein the sabot assembly is comprised of a plurality of elongated sections pivotally connected at aft ends to a sealing feature, the elongated sections pivoting at the sealing feature radially outwardly from the closed position to the open position.

6. The non-lethal payload delivery assembly of claim 1 wherein the plurality of sections are elongated sections coupled together at an aft end and having free forward ends that define a substantially cylindrical portion when the elongated sections are in the closed position, the forward ends adapted to flare radially outward when the elongated sections move to the open position.

7. The non-lethal payload delivery assembly of claim 1, further comprising a retention member retaining the sections of the sabot assembly in the closed position until the sabot assembly is launched.

8. The non-lethal payload delivery assembly of claim 1, further comprising a launching energy source connected to the sabot assembly and configured to generate the launch forces within the launching device.

9. A non-lethal payload carrier assembly launchable from a launching device toward a target, comprising:

a mortar-launched, unitary carrier body constructed of a fracturable non-metallic material, the carrier body having a body portion and a flight stabilizing portion integrally connected to the body portion, the body portion having an interior cavity, and the flight stabilizing portion having a plurality of stabilizing fins, the carrier body being fracturable into a plurality of non-lethal pieces after launch;

an isolating member releasably containing the carrier body and isolating the carrier body from the launching device during launch;

a non-lethal payload releasably contained within the interior cavity of the body portion; and a payload deployment system connected to the carrier body and having a fuse mechanism and a fracturing device connected to the fuse mechanism, the fracturing device being positioned in the interior area and along the carrier body between the non-lethal payload and the body portion and being activatable by the fuse mechanism to apply a deployment force to the body portion that fractures and opens the carrier body after launch and at a position away from the target for deployment of the non-lethal payload toward the target, the carrier body configured to fracture into the plurality of non-lethal pieces away from the target when the fracturing device is activated.

10. The assembly of claim 9 wherein the carrier body is constructed of a molded fiber material.

11. The assembly of claim 9 wherein the fracturing device includes plurality of explosive charges affixed to the carrier body, and the fuse mechanism is an airburst fusing system.

12. The assembly of claim 9 wherein the payload deployment system includes a position detector coupled to the fuse mechanism and adapted to activate the fuse mechanism.

13. A non-lethal payload delivery system, comprising:

a launching device;

a non-lethal payload deliverable to a target;

a carrier assembly releasably containing the non-lethal payload, the carrier assembly being openable and fracturable into a plurality of non-lethal pieces for deployment of the non-lethal payload prior to delivery to the target;

a payload deployment system coupled to the carrier assembly and having a mechanism for opening the carrier assembly away from the target and deployment of the non-lethal payload during flight;

a sabot assembly sized to be launched from the launching device, the sabot assembly releasably containing the carrier assembly and isolating the carrier assembly from launch loads that exceed a strength of the carrier assembly, the sabot assembly having a plurality of sections movable from a closed position to a flared open position upon exit from the launching device, the sabot assembly being separable from the carrier assembly when the plurality of sections move to the flared open position.

14. The system of claim 13 wherein the non-lethal payload includes one of an airborne irritant agent, shot-filled bag, foam, flash/bang grenade, rubber pellet, and anti-traction agent.

15. The system of claim 13 wherein the carrier assembly is fabricated from molded fiber materials.

16. The system of claim 13 wherein the plurality of sections are elongated sections coupled together at an aft end and having free forward ends that define a substantially cylindrical portion when the elongated sections are in the closed position, the forward ends adapted to flare radially outward when the elongated sections move to the open position.

17. The system of claim 13, further comprising a retention member retaining the sections of the sabot assembly in the closed position until the sabot assembly is launched.

18. The system of claim 13, further comprising an energy-absorbent material imposed between the carrier assembly and the sabot assembly.

19. A method of delivering a non-lethal payload to a remote target, comprising:

loading a non-lethal payload delivery assembly into a launching device, the assembly including a non-lethal payload, a carrier assembly releasably containing the non-lethal payload, and a sabot assembly releasably containing the carrier assembly, the sabot assembly having a plurality of sections movable from a closed position substantially surrounding the carrier assembly to an open position exposing the carrier assembly upon launch from the launching device;

launching the non-lethal payload assembly as a unit out of the launching device, wherein launching forces are generated in the launching device and exerted against the sabot assembly, the launching forces exceeding forces that the carrier assembly could withstand independent of the sabot assembly;

absorbing launch forces by the sabot assembly during launch;

moving the plurality of sections of the sabot assembly from the closed position to the open position when the sabot assembly exits the launching device causing deceleration of the sabot assembly and separation from the carrier assembly;

allowing the carrier assembly and the non-lethal payload to travel along a trajectory toward the target after separation from the sabot assembly;

opening the carrier assembly at a selected position along the trajectory away from the target;

deploying the non-lethal payload from the carrier assembly after the carrier assembly is open for continued travel of the non-lethal payload to the target independent from the carrier assembly; and breaking the carrier assembly into a plurality of non-lethal pieces when the carrier assembly is open and the non-lethal payload is deployed.

20. The method of claim 19 wherein opening the carrier assembly includes igniting a plurality of explosive charges at a selected position along the trajectory away from the target.

21. The method of claim 19 wherein the carrier assembly is a non-metallic fiber material and breaking the carrier into a plurality of pieces includes increasing the aerodynamic drag and air pressure on the carrier assembly upon opening the carrier assembly and shredding the carrier assembly into the plurality of pieces with the increased air pressure.

* * * * *